US007736058B2

(12) United States Patent
Tanaka et al.

(10) Patent No.: US 7,736,058 B2
(45) Date of Patent: Jun. 15, 2010

(54) CHUCK TAPE AND PACKAGING BAG WITH CHUCK TAPE

(75) Inventors: Kenichi Tanaka, Sodegaura (JP); Ryo Katada, Sodegaura (JP); Yoshinori Nanba, Sodegaura (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 556 days.

(21) Appl. No.: 11/597,131

(22) PCT Filed: May 19, 2005

(86) PCT No.: PCT/JP2005/009159

§ 371 (c)(1),
(2), (4) Date: Nov. 20, 2006

(87) PCT Pub. No.: WO2005/112682

PCT Pub. Date: Dec. 1, 2005

(65) Prior Publication Data

US 2008/0031552 A1 Feb. 7, 2008

(30) Foreign Application Priority Data

May 21, 2004 (JP) ..... 2004-152125

(51) Int. Cl.
*B65D 33/16* (2006.01)
*A44B 19/00* (2006.01)

(52) U.S. Cl. ..... 383/63; 24/585.12

(58) Field of Classification Search ..... 383/61.2, 383/63; 24/585.12
See application file for complete search history.

(56) References Cited

U.S. PATENT DOCUMENTS 5,700,091 A * 12/1997 Tanaka et al. ..... 383/63

(Continued)

FOREIGN PATENT DOCUMENTS

JP 02-258562 10/1990

(Continued)

OTHER PUBLICATIONS

Patent Abstract of Japan—Publication No. 09-278009—Publication Date Oct. 28, 1997—Dog Device And Packing Bag With the Same—Tanaka Kenichi.

(Continued)

*Primary Examiner*—Jes F Pascua
(74) *Attorney, Agent, or Firm*—Millen, White, Zelano & Branigan, P.C.

(57) ABSTRACT

Disclosed are a reclosable tape that can be manufactured easily and stably, exhibit excellent adhesion strength regardless of a material type of a sealant layer (innermost layer) of a base material film of a bag body and good formability of an engaging portion in manufacturing; and a packaging bag with the reclosable tape. The reclosable tape 1 includes a male member 11 and a female member 12 and the packaging bag with the reclosable tape are so arranged that: a belt-shaped base 13 of the reclosable tape 1 includes a seal portion 14 and a base portion 15; a resin forming the base portion 15 has a melting point higher than that of a resin forming the seal portion 14; and the resin forming the seal portion 14 contains 50 mass % or more of a metallocene-type linear-low-density polyethylene having density of 920 kg/m3 or lower, melt flow rate of 5.0 g/l 10 min or lower.

7 Claims, 4 Drawing Sheets

U.S. PATENT DOCUMENTS

| | | | | |
|---|---|---|---|---|
| 5,741,861 | A * | 4/1998 | Yamamoto et al. | 525/240 |
| 5,770,318 | A * | 6/1998 | Friedman | 428/500 |
| 5,817,380 | A * | 10/1998 | Tanaka | 383/63 |
| 5,874,139 | A * | 2/1999 | Bosiers et al. | 428/35.2 |
| 5,955,160 | A * | 9/1999 | Tanaka et al. | 383/63 |
| 6,029,931 | A * | 2/2000 | Encarthe et al. | 244/50 |
| 6,092,931 | A * | 7/2000 | Tilman | 383/63 |
| 6,423,420 | B1 * | 7/2002 | Brant et al. | 428/516 |
| 6,620,897 | B1 * | 9/2003 | Smillie | 526/171 |
| 2003/0022999 | A1 * | 1/2003 | Kagami et al. | 525/240 |
| 2005/0210638 | A1 * | 9/2005 | Gradl | 24/400 |
| 2005/0266190 | A1 * | 12/2005 | Zhang et al. | 428/35.7 |

FOREIGN PATENT DOCUMENTS

| | | |
|---|---|---|
| JP | A-7-26230 | 1/1995 |
| JP | A-8-3521 | 1/1996 |
| JP | 10-297652 | 4/1997 |
| JP | 09-276009 A | 10/1997 |
| JP | 10-000107 A | 1/1998 |
| JP | A-11-12553 | 1/1999 |
| JP | 2002-136308 | 8/2001 |

OTHER PUBLICATIONS

Patent Abstract of Japan—Publication No. 10-000107—Publication Date Jan. 06, 1998—Mesh Tool and Packaging Bag With Mesh Tool—Tanaka Kenichi et al.

Office Action for JP 2004-152125 with English Translation—Jan. 21, 2010, Kinoshita & Associates et al.

* cited by examiner

CHUCK TAPE AND PACKAGING BAG WITH CHUCK TAPE

TECHNICAL FIELD

The present invention relates to a reclosable tape that is openable and reclosable and is disposed at an opening of a bag body, and to a packaging bag with the reclosable tape.

BACKGROUND ART

A packaging bag with a reclosable tape typically used as a packaging material for packaging various articles such as foods and medical products is provided with a reclosable tape (engaging member) having a belt-like shape at an opening of the bag, the reclosable tape including a pair of a male member and a female member that are engaged with each other in a manner openable and reclosable.

As a typical method for manufacturing such packaging bag with the reclosable tape that allows opening and resealing of the opening of the bag, there is typically and widely used a method including making the reclosable tape in advance and heat-sealing the reclosable tape to a base material film as a component material of a bag body.

In an arrangement of such reclosable tape, the reclosable tape has been formed from a resin that is the same as that forms an innermost layer (sealant layer) of the base material film so that the reclosable tape can be heat-sealed to the base material film with ease. The innermost layer of the base material film has been typically formed from a low-density polyethylene (LDPE) or a propylene (PP), and in such case, the low-density polypropylene (LDPE) or the polypropylene (PP) has also been used as a component material of the reclosable tape, the reclosable tape heat-sealed to the sealant layer (the innermost layer) of the base material film.

Meanwhile, there has also been proposed another arrangement of a reclosable tape in which an engaging portion including a male member and a female member and a seal portion that is welded to a sealant layer (innermost layer) of a bag body are formed from different resins (see, for instance, Patent Document 1). In the reclosable tape with such arrangement, the male member and the female member are formed from a resin having a melting point higher than a resin that forms the seal portion, so that the male member and the female member can be prevented from being deformed when the reclosable tape is heat-sealed to the bag body.

[Patent Document 1] JP-A-10-297652 (claim 1 and FIGS. 1 and 4)

DISCLOSURE OF THE INVENTION

Problems to be Solved by the Invention

However, in the conventional arrangements of the reclosable tape as described above, a material used for the seal portion has to be selected depending on a type of the sealant layer (innermost layer) of the base material film of the bag body to which the reclosable tape is welded. In such arrangement, with the reclosable tape having the seal portion that is formed from the polyethylene for instance, the heat-sealing can be performed properly when the sealant layer of the bag body is also formed from the polyethylene, while the heat-sealing becomes difficult when the sealant layer is formed from the polypropylene.

In the arrangement as disclosed in Patent Document 1 in which the engaging portion and the seal portion of the reclosable tape are formed from different resins, formability of the reclosable tape during manufacturing and molding stability after molding are poor, which might cause the engaging portion to be deformed.

Accordingly, an object of the present invention is to provide a reclosable tape that can be manufactured easily and stably, exhibit excellent adhesion strength regardless of a material type of a sealant layer (innermost layer) of a base material film of a bag body as well as good formability of an engaging portion in manufacturing the reclosable tape, and to provide a packaging bag with the reclosable tape.

Means for Solving the Problems

In order to achieve the object, a reclosable tape according to an aspect of the present invention includes a pair of a male member and a female member each having a belt-shaped base including an engaging portion, in which: the belt-shaped portion includes a seal portion and a base portion that is formed continuously from and integrally with the engaging portion; a resin that forms the base portion has a melting point higher than a resin that forms the seal portion; and the resin that forms the seal portion contains 50 mass % or more of a metallocene-type linear low-density polyethylene having a density of 920 kg/m$^3$ or lower and a melt flow rate (MFR) of 5.0 g/10 min or lower.

In the reclosable tape according to the aspect of the invention, the resin that forms the seal portion contains 50 mass % or more of the metallocene-type linear low-density polyethylene having the density of 920 kg/m$^3$ or lower and the melt flow rate (MFR) of 5 g/10 min or lower. With the arrangement, the heat-sealing can be performed properly not only when the sealant layer (innermost layer) of the bag body to which the reclosable tape is heat-sealed is formed from a polyethylene but also when the sealant layer is formed from a polypropylene, thus providing the reclosable tape that has good heat-sealability with the bag body regardless of a material type of the innermost layer of the bag body.

In the reclosable tape according to the aspect of the present invention, it is preferable that the resin that forms the seal portion contains: 50 to 99 mass % of the metallocene-type linear low-density polyethylene having the density of 920 kg/m$^3$ or lower and the melt flow rate (MFR) of 5.0 g/10 min or lower; and 1 to 50 mass % of a metallocene-type linear low-density polyethylene having a density of 920 kg/m$^3$ or lower and a melt flow rate (MFR) of higher than 5.0 g/10 min and/or a copolymer of a propylene and an $\alpha$-olefin having a carbon number of 4 to 8.

According to the aspect of the present invention, the resin that forms the seal portion contains 50 to 99 mass % of the metallocene-type linear low-density polyethylene having the density of 920 kg/m$^3$ or lower and the melt flow rate (MFR) of 5.0 g/10 min or lower, and further contains 1 to 50 mass %, as the balance of the resin, of the metallocene-type linear low-density polyethylene having the density of 920 kg/m$^3$ or lower and the MFR of higher than 5 g/10 min and/or the copolymer of the propylene and the $\alpha$-olefin having the carbon number of 4 to 8. With the arrangement, when the reclosable tape is manufactured by co-extrusion, the reclosable tape, especially the engaging portion, exhibits proper formability and shape stability during molding, thereby preventing the shape of the reclosable tape from being deformed.

Herein, in a case where the reclosable tape is manufactured by coextrusion, when the seal portion is formed only from the metallocene-type linear low-density polyethylene having the melt flow rate (MFR) of 5 g/10 min or lower, the resin of the base portion flows toward the male member and the female member in a die and causes a tip end on the female member of the engaging portion to become likely closed, which might make it difficult to extrude the reclosable tape into a predetermined openable/reclosable shape. On the other hand, according to the aspect of the present invention, since the seal portion is formed from the metallocene-type linear low-density polyethylene having the MFR of 5 g/10 min or lower and the metallocene-type linear low-density polyethylene having high fluidity with the MFG of higher than 5 g/10 min and/or the copolymer of the propylene and the α-olefin having the carbon number of 4 to 8, deformation of the female member and the like can be properly prevented.

The copolymer of the propylene and the α-olefin having the carbon number of 4 to 8 may preferably be a copolymer of the propylene and a butene-1, which provides proper adhesion strength of the seal portion and the base portion in addition to the advantages described above.

In the reclosable tape according to the aspect of the present invention, it is preferable that a melting point of the resin that forms the base portion is 10° C. or more higher than that of the resin that forms the seal portion. With the arrangement, the base portion can be prevented from being deformed during the heat-sealing, thereby providing the reclosable tape that can be properly heat-sealed to the bag body.

In the reclosable tape according to the aspect of the present invention, it is preferable that the resin that forms the base portion contains a random polypropylene (RPP) having a melt flow rate (MFR) of 3 to 10 g/10 min.

According to the aspect of the present invention, the resin that forms the base portion contains the random polypropylene (RPP) having the melt flow rate (MFR) of 3 to 10 g/10 min, thus realizing the reclosable tape in which the engaging portion that is formed continuously from and integrally with the base portion has good reopenability/resealability. In addition, since the random polypropylene (RPP) is a relatively inexpensive resin, using the random polypropylene (RPP) as a material component of the base portion will reduce the cost in manufacturing the reclosable tape.

A packaging bag with a reclosable tape according to another aspect of the present invention is formed by welding (heat-sealing) the above-described reclosable tape of the present invention to a bag body.

According to the aspect of the present invention, since the packaging bag with the reclosable tape is formed by welding the above-described reclosable tape of the present invention to the bag body, the packaging bag can also attain the advantages of the reclosable tape of the present invention.

Specifically, in the packaging bag with the reclosable tape of the present invention, the seal portion of the reclosable tape can be heat-sealed to the innermost layer (sealant layer) of the bag body regardless of the type of the innermost layer, for instance, the reclosable tape can be properly heat-sealed not only when the innermost layer is formed from the polyethylene but also when formed from the polypropylene. Therefore, the packaging bag with a high quality reclosable tape can be provided.

As described above, the packaging bag with the reclosable tape according to the present invention has a remarkable feature in which excellent heat-sealability can be provided even when the sealant layer (innermost layer) of the bag body is formed from the polypropylene resin.

EXPLANATION OF CODES

| | |
|---|---|
| 1: | reclosable tape |
| 10: | engaging portion |
| 11: | male member |
| 12: | female member |
| 13: | belt-shaped base |
| 14: | seal portion |
| 15: | base portion |
| 16: | head |
| 17: | connecting portion |
| 18: | first hook |
| 19: | second hook |
| 20: | bag body |
| 21: | side seal portion |
| 30: | packaging bag with reclosable tape |
| 40: | additional layer |

BEST MODE FOR CARRYING OUT THE INVENTION

A first embodiment of a reclosable tape and a packaging bag with the reclosable tape (hereinafter, referred to simply as "a packaging bag" in some cases) of the present invention will be described with reference to FIGS. 1 and 2.

Figure 1:
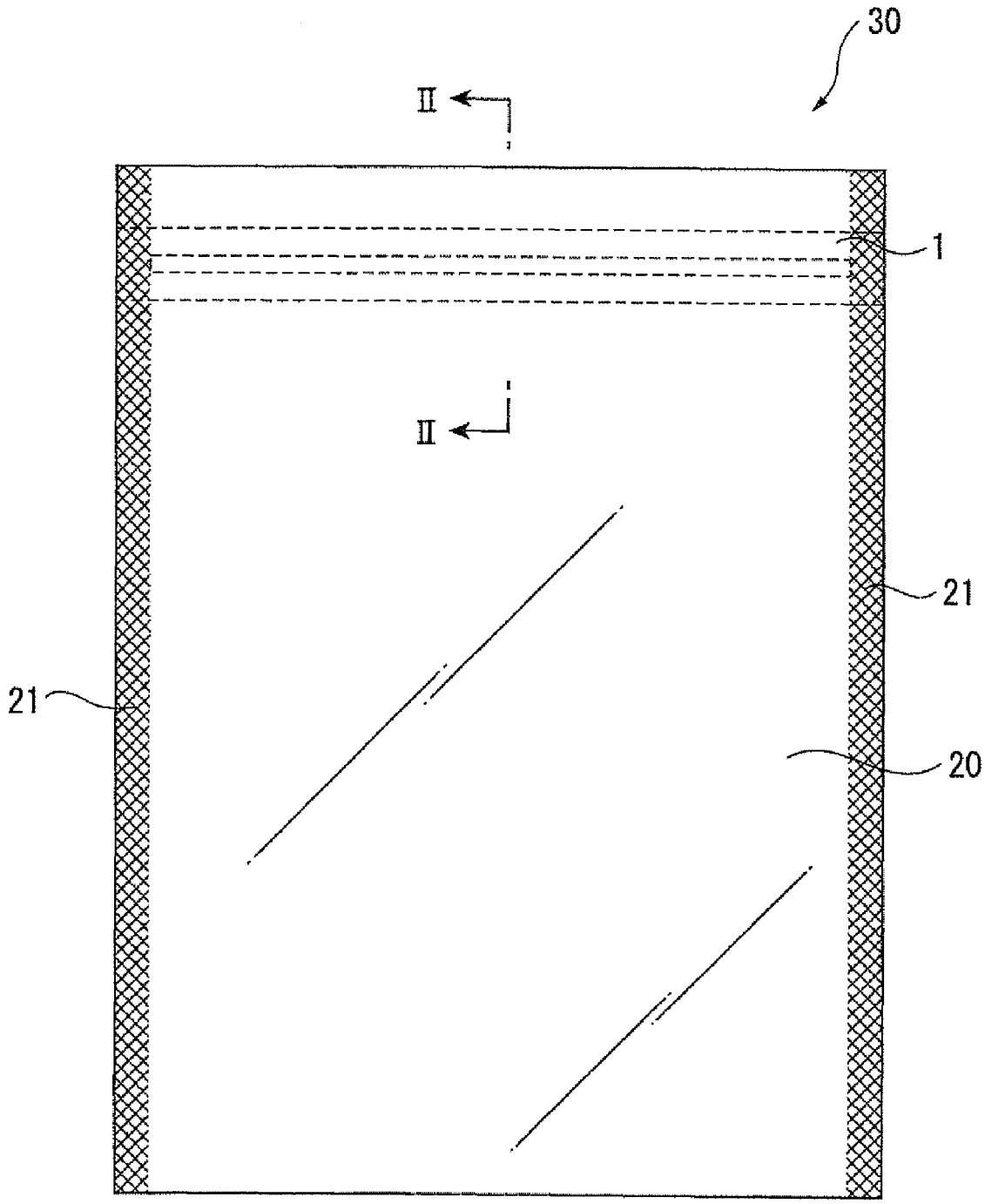
FIG. 1 is a front view showing an embodiment of a packaging bag with a reclosable tape according to the present invention.

FIG. 1 is a front view showing the packaging bag with the reclosable tape in which the reclosable tape of the present invention is welded to a bag body. FIG. 2 is a cross section taken along the line II-II in FIG. 1, in which the reclosable tape of the present invention is welded to the bag body of the packaging bag (with an engaging portion being engaged).

Figure 2:
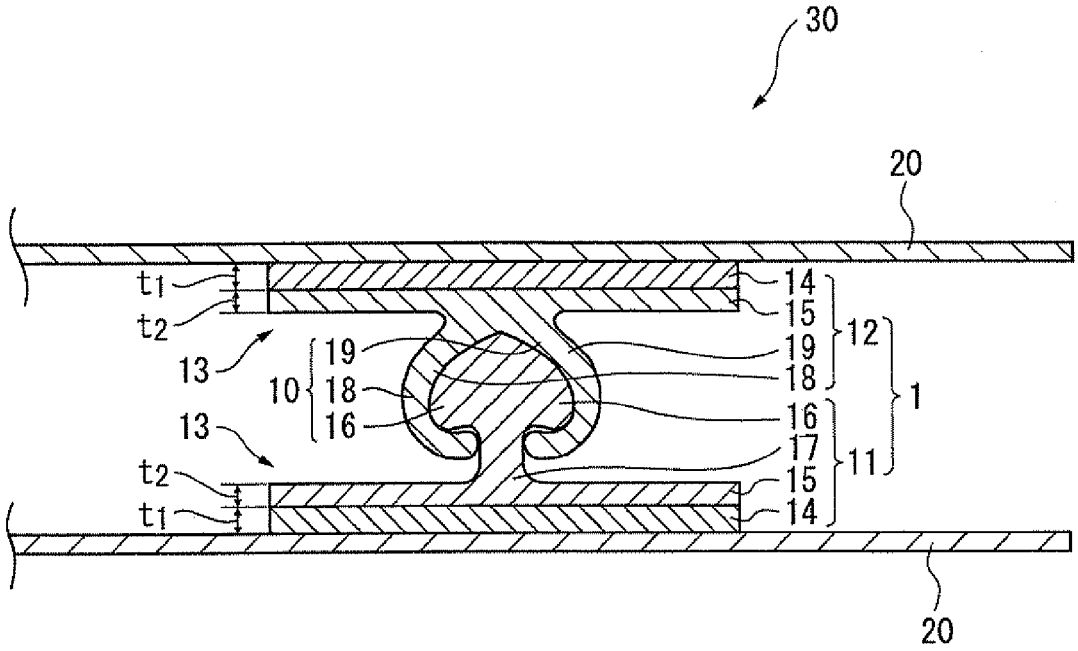
FIG. 2 is a cross section taken along the line II-II in FIG. 1 for showing an engaging state of a male member and a female member.

In FIGS. 1 and 2, the reference numeral 1 denotes the reclosable tape, 10 denotes the engaging portion, 11 denotes a male member, 12 denotes a female member, 13 denotes a belt-shaped base, 14 denotes a seal portion, 15 denotes a base portion, 16 denotes a head, 17 denotes a connecting section, 18 denotes a first hook, 19 denotes a second hook, 20 denotes a bag body, 21 denotes a side seal portion and 30 denotes the packaging bag.

The reclosable tape 1 of the present embodiment includes, as shown in the cross section of FIG. 2, the male member 11 provided on one side and the female member 12 provided to the other side so as to engage with the male member 11, the male and female members 11, 12 each formed from a thermoplastic resin and having a belt-like shape.

Here, the male member 11 includes a belt-shaped base 13 that is welded to the bag body 20, a head 16 having a substantially mushroom-like cross section and a connecting section 17 for connecting the belt-shaped base 13 and the head 16, the male member 11 formed integrally.

The female member 12 includes, similarly to the above-described male member 11, a belt-shaped base 13 that is welded to the bag body 20 and a first hook portion 18 and a second hook portion 19 that are each formed arcuately and continuously from the belt-shaped base 13, the first and second hooks 18, 19 facing each other.

In the reclosable tape 1, the head 16 of the male member 11 and the first and second hooks 18, 19 of the female member 12 constitute the engaging portion 10, engaging or releasing of which allows the packaging bag to be opened or resealed.

As shown in FIG. 2, the belt-shaped base 13 of the reclosable tape 1 includes the seal portion 14 and the base portion 15 that is formed continuously from and integrally with the engaging portion 10.

In the male member 11 of the reclosable tape 1 of the present embodiment, the base portion 15 of the belt-shaped base 13, the head 16 and the connecting portion 17 are integrally formed from a resin that forms the base portion 15. Similarly, in the female member 12, the base portion 15 of the belt-shaped base 13 and the first and second hooks 18, 19 are integrally formed from the resin that forms the base portion 15.

The seal portions 14 of the belt-shaped bases 13 each constituting the male member 11 and the female member 12 are provided on outer surfaces of the reclosable tape, the seals portions 14 heat-sealed to a sealant layer (innermost layer) of the bag body 20.

In the reclosable tape 1 of the present invention, the resin that forms the seal portion 14 contains a metallocene-type linear low-density polyethylene having a density of 920 kg/m$^3$ or lower and a melt flow rate (MFR) of 5 g/10 min or lower (hereinafter, referred to as "specific metallocene-type linear low-density polyethylene" in some cases) in an amount of 50 mass % or more of the total amount of the seal portion 14, preferably 50 to 99 mass %, and particularly preferably 70 to 99 mass %. If the seal portion 14 contains 50 mass % or more of a linear low-density polyethylene having the density of higher than 920 kg/m$^3$ and the MFR of higher than 5 g/10 min, the adhesion performance of the seal portion 14 to the sealant layer (innermost layer) of the bag body 20 becomes poor. Accordingly, the adhesion strength becomes insufficient, where the seal portion 14 is easily peeled off from the sealant layer by hand even after the seal portion 14 is heat-sealed to the sealant layer. Thus, the seal portion 14 cannot be properly heat-sealed to the bag body 20 which is formed from, especially, the polypropylene resin.

The density of the metallocene-type linear low-density polyethylene is preferably 850 to 910 kg/m$^3$, and particularly preferably 860 to 905 kg/m$^3$ or more. The MFR is preferably 1 to 5 g/10 min.

Incidentally, the density may be measured in compliance with JIS K 7112, while the MFR may be measured in compliance with JIS K 7210 (at 190° C., loading: 21.18 N). Both JIS K 7112 and JIS K 7210 are well known testing methods of plastics.

Meanwhile, other resins contained as component materials of the seal portion 14 are preferably those exhibiting good compatibility or good miscibility with the above-described specific metallocene-type linear low-density polyethylene as an essential component material and being capable of maintaining good adhesion performance with the sealant layer (especially, the sealant layer formed from the polypropylene resin) of the bag body 20. Examples of the other resins may include: a metallocene-type linear low-density polyethylene having a density of 920 kg/m$^3$ or lower and a melt flow rate (MFR) of higher than 5.0 g/10 min; a copolymer of a propylene and an α-olefin having a carbon number of 4 to 8, the copolymer preferably having a MFR (190° C., loading: 21.18 N) of 0.5 to 20 g/10 min; Ziegler-type linear low-density polyethylene; and an ethylene-polar vinyl copolymer, one of which may be used alone or two or more of which may be used in combination.

As the other resins contained in addition to the specific metallocene-type linear low-density polyethylene for forming the seal portion 14 of the reclosable tape 1 of the present invention, it is particularly preferable to use, among the above-listed resins, the metallocene-type linear low-density polyethylene having the density of 920 kg/m$^3$ or lower and the melt flow rate (MFR) of higher than 5.0 g/10 min and the copolymer of the propylene and the α-olefin having the carbon number of 4 to 8, the copolymer preferably having the MFR of 0.5 to 20 g/10 min. By using these resins as the other resins used in addition to the specific metallocene-system linear low-density polyethylene, the engaging portion 10 (especially, the connecting portion 17 of the male member 11) can be prevented from being deformed when the reclosable tape 1 is extruded. Incidentally, one of the resins may be used alone or two of them may be used in combination.

Herein, in a case where the reclosable tape 1 is manufactured by coextrusion, when the seal portion 14 is formed only from the metallocene-type linear low-density polyethylene having the melt flow rate (MFR) of 5 g/10 min or lower, the resin of the base portion 15 might flow toward the male member 11 and the female member 12 in a die and causes a tip end of the first and second hooks 18, 19 of the female member 12 to become likely closed (or causes the connecting portion 17 of the male member 11 to be likely tilted down), which might make it difficult to extrude the reclosable tape into a predetermined reopenable/reclosable shape. On the other hand, according to the present invention, by adding the metallocene-type linear low-density polyethylene having high fluidity with the MFG of higher than 5 g/10 min and/or the copolymer of the propylene and the α-olefin having the carbon number of 4 to 8 to the metallocene-type linear low-density polyethylene having the MFR of 5 g/10 min or lower for forming the seal portion 14, deformation of the female member 12 can be properly prevented.

Content of these other resins in the seal portion 14 is preferably 1 to 50 mass %, and particularly preferably 5 to 40 mass %. When the content is below 1 mass %, the effect for preventing the deformation of the engaging portion 10 might not be obtained. On the other hand, when the content exceeds 50 mass %, sealability in a low temperature might be degraded and heat-sealability to the bag body 20, especially to the bag body 20 with its sealant layer formed from the polypropylene resin, might be degraded, which is not preferable.

Note that, among the other resins, by using a copolymer of the propylene and a butene-1 as the copolymer of the propylene and the α-olefin having the carbon number of 4 to 8, the copolymer having the MFR of 0.5 to 20 g/10 min, the adhesion strength between layers of the seal portion 14 and the base portion 15 is enhanced in addition to the above-described advantages, which is preferable. Here, the MFR of the copolymer is preferably 1 to 10 g/10 min, particularly preferably 2 to 8 g/10 min.

Next, as for a resin that forms the base portion 15, a resin having a melting point higher than the resin that forms the seal portion 14 is employed. Here, the melting point of the resin that forms the base portion 15 is preferably 10° C. or higher than that forming the seal portion 14. Examples of the resin that forms the base portion 15 may include a copolymer containing an ethylene as a main component such as a random polypropylene (RPP), a low-density polyethylene (LDPE), an ethylene-vinyl acetate copolymer (EVA), an ethylene-methacrylic acid copolymer (EMAA), one of which may be used alone or two or more of which may be used in combination. By forming the base portion 15 from the resin having the melting point higher than that of the resin that forms the seal portion 14, the thermal effect on the belt-shaped base 13 can be reduced when the reclosable tape 1 is welded to the bag body 20, thereby preventing the base portion 15 from being deformed during the heat-sealing. In addition, the heat-sealing conditions can be widened, e.g., the seal portion 14 can be heat-sealed to the bag body 20 at a low temperature.

Among the above-listed resins for forming the base portion 15 of the reclosable tape of the present invention, the random polypropylene (RPP) is preferable for use. By forming the base portion 15 from the random polypropylene, wrinkle, which is typically generated due to heat shrinkage of the reclosable tape 1 when the sealant layer (innermost layer) of the bag body 20 contains the polyethylene, can be prevented from being generated on the bag body 20.

By using the resin containing 50 to 99 mass % of the specific metallocene-type linear low-density polyethylene and 1 to 50 mass % of the metallocene-type linear low-density polyethylene having the density of 920 kg/m$^3$ or lower and the MFR of higher than 5.0 g/10 min and/or the copolymer of the propylene and the α-olefin having the carbon number of 4 to 8 for the seal portion 14, while by using the resin which is the random polypropylene for the base portion 15, the fluidities of the seal portion 14 and the base portion 15 become uniform and the extrusion speeds can also be substantially uniform when the reclosable tape is manufactured by co-extrusion. Accordingly, unnecessary shearing stress does not act on the random polypropylene that forms the base portion 15, thereby preventing the deformation of the engaging portion 10 (especially the connecting portion 17 of the male member 11) more properly.

The random polypropylene used for the base portion 15 preferably contains an ethylene component in an amount of 2.0 to 8.0 mass %, and particularly preferably 3.0 to 6.0 mass %. When the content of the ethylene component contained in the random polypropylene is below 2.0 mass %, reopenability and resealability of the engaging portion 10 might be degraded. On the other hand, when the content of the ethylene component exceeds 8.0 mass %, difference in the melting points between the seal portion 14 and the base portion 15 becomes small, which makes it difficult to increase a heat-sealing speed for heat-sealing the reclosable tape 1 to the bag body 20 to enhance productivity.

The melt flow rate (MFR) of the random polypropylene (RPP) is preferably 3 to 10 g/10 min, and particularly preferably 5 to 9 g/10 min. The MFR of the random polypropylene of below 3 g/10 min might degrade extrusion-moldability of the engaging portion 10 that is formed continuously from and integrally with the base portion 15. On the other hand, the MFR exceeding 10 g/10 min might cause tips of the first and second hooks 18, 19 of the female member to be likely closed or might cause the connecting portion 17 of the male member 11 to be likely tilted down, which might make it difficult to extrude the reclosable tape 1 into a predetermined reopenable/reclosable shape.

In FIG. 2, the thickness $t_1$ of the seal portion 14 and the thickness $t_2$ of the base portion 15 of the belt-shaped base 13 are arranged such that the thickness $t_1$ of the seal portion 14 is preferably 1 to 30% of the thickness $t_2$ of the base portion 15, particularly preferably 5 to 15%. With the thickness of the seal portion 14 being below 1% of the base portion 15, a seal portion of the bag body 20 might shrink and cause wrinkle to be generated after the heat-sealing when the reclosable tape 1 is heat-sealed to the bag body 20. On the other hand, with the thickness of the seal portion 14 exceeding 30% of the base portion 15 a so-called sharkskin, where a surface of the extruded product will have regular undulation, might occur when the reclosable tape is co-extruded to manufacture, which might degrade the appearance of not only the seal portion 14 but also the base portion 15.

Incidentally, in FIG. 2, the thickness $t_1$ of the seal portion 14 of the belt-shaped base 13 may be approximately 10 to 20 μm.

The male member 11 of the reclosable tape 1 of the present embodiment can be obtained by co-extrusion, where the belt-shaped portion 13 including the seal portion 14 and the base portion 15 and the head 16 and the connected portion 17 that are formed continuously from the base portion 15 of the male member 11 are integrally formed.

Similarly, the female member 12 can be obtained by co-extrusion, where the belt-shaped portion 13 including the seal portion 14 and the base portion 15 and the first and second hooks 18, 19 that are formed continuously from the base portion 15 are integrally formed. By co-extruding the reclosable tape 1 as described above, the reclosable tape 1 can be manufactured continuously and stably.

By welding the reclosable tape 1 to a film base material of the bag body 20 and forming the film base material into a bag, the packaging bag 30 with the reclosable tape as shown in FIG. 1 can be obtained.

Examples of the film base material may include: a linear low-density polyethylene (LLDPE), a high-density polyethylene (HDPE), a cast polypropylene (CPP); and laminated films laminated by dry laminating or extrusion laminating such as a polyethylene terephthalate (PET)/LLDPE, a PET/CPP, an oriented polypropylene (OPP)/CPP, a nylon/linear low-density polyethylene (LLDPE) and a metal- or an inorganic substance-deposited PET/LLDPE.

Note that such packaging bag 30 with the reclosable tape can be easily manufactured using, for instance, a commercially-available bag making machine for three-sided sealing and attaching a reclosable tape (engaging member).

In such case, welding conditions (temperature, pressure, etc.) can be properly determined in accordance with types of the resins used for the reclosable tape 1 and the film base material for forming the bag body 20.

With the above-described reclosable tape 1 of the present embodiment, the following advantages can be attained.

In the reclosable tape 1 of the present embodiment, the resin that forms the seal portion 14 heat-sealed to the bag body 20 contains 50 mass % or more of the metallocene-type linear low-density polyethylene having the density of 920 kg/m$^3$ or lower and the melt flow rate (MFR) of 5 g/10 min or lower. With the arrangement, the heat-sealing can be performed properly not only when the sealant layer (innermost layer) of the bag body 20 to which the reclosable tape 1 is heat-sealed is formed from the polyethylene but also when the sealant layer is formed from the polypropylene, thus enhancing heat-sealability regardless of the material types of the innermost layer of the bag body 20.

Also, in the packaging bag 30 with the reclosable tape that is formed by welding the reclosable tape 1 to the bag body 20, even when the sealant layer (innermost layer) of the bag body 20 is formed from the polypropylene, the seal portion 14 of the reclosable tape 1 can be properly heat-sealed to the sealant layer, thereby providing a high-quality packaging bag 30 with the reclosable tape.

It should be noted that the embodiment described above is only an exemplary embodiment of the present invention. The present invention is not limited to the above-described embodiment but includes modifications and improvements as long as the object and the advantages of the present invention can be attained. Also, specific structure and shape of the components in the present invention may be designed in any manner as long as the object and the advantages of the present invention can be achieved.

Figure 3:
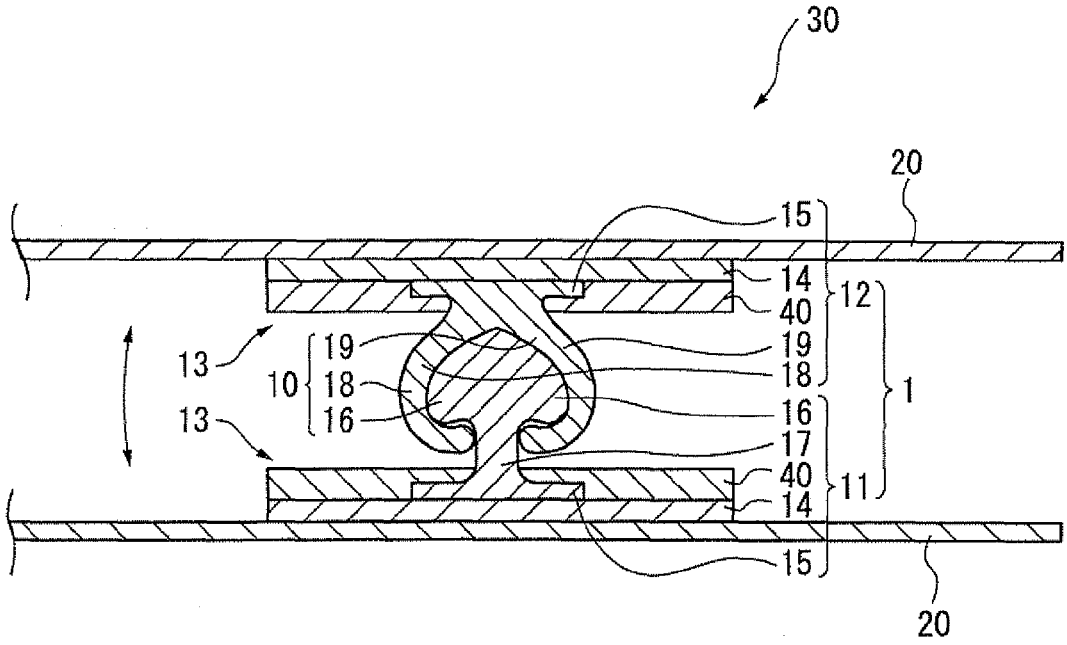
FIG. 3 is a cross section showing another embodiment of a reclosable tape according to the present invention.

Although the belt-shaped base 13 of the reclosable tape 1 only includes the seal portion 14 and the base portion 15 in the above-described embodiment as shown in FIG. 2, the arrangement is not limited thereto. As an example, as shown in FIG. 3, the reclosable tape 1 of the present invention may be provided with an additional layer 40 on the upper surface of the base portion 15 (the surface on which the engaging portion 10 is formed) so that the base portion 15 defines an undercut in the additional layer 40 in an opening/closing direction (shown by the arrow in FIG. 3) of the reclosable tape 1.

Figure 4:
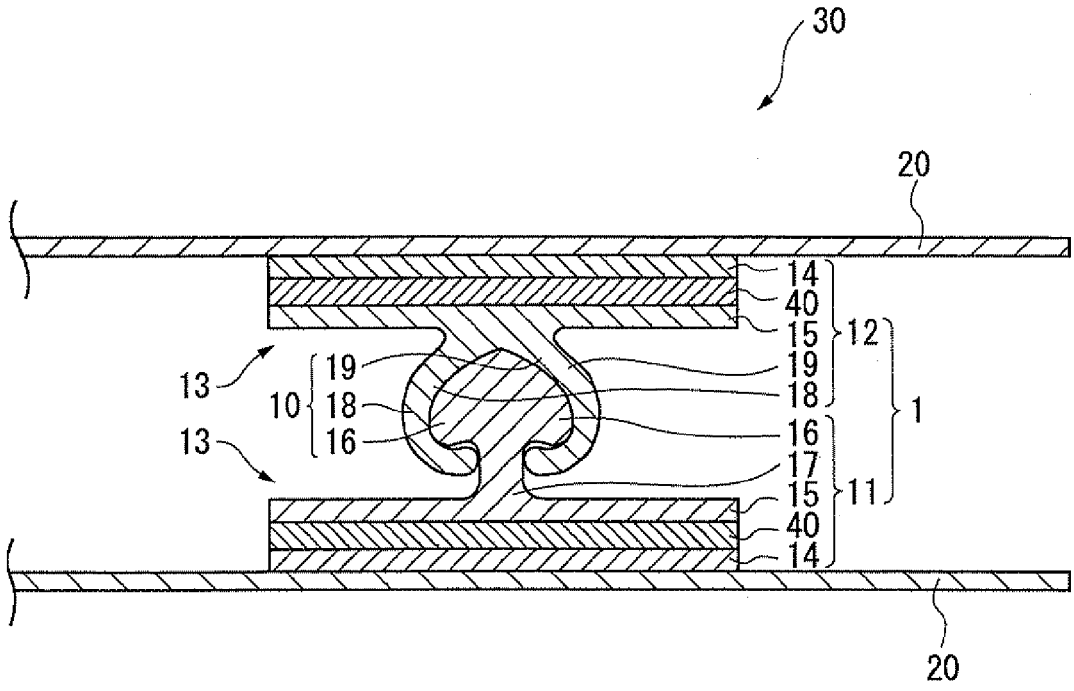
FIG. 4 is a cross section showing still another embodiment of a reclosable tape according to the present invention.

As another example, the reclosable tape 1 of the present invention may be provided with an additional layer 40 between the seal portion 14 and the base portion 15 as shown in FIG. 4. In addition, a plurality of additional layers 40 may be provided.

In the above-described embodiment, the reclosable tape 1 includes the engaging portion 10 in which the head 16 having a substantially mushroom-like shape of the male member 11 and the first and second hooks 18, 19 each having a substantially arc shape of the female member 12 are engaged with and released from each other, the reclosable tape 1 being opened or resealed through the engagement and release. However, the shape of the engaging portion 10 is not limited to the one in the above-described embodiment but may be any shape as long as the engaging portion 10 has a function for opening and resealing. Specifically, the shape and the number of the heads 16 of the male member 11 and the shapes and the numbers of the first and second hooks 18, 19 of the female member may be arbitrarily determined.

Although the range of the thickness $t_1$ of the seal portion 14 is described in the above-described embodiment, the thickness is also determined arbitrarily as long as the advantages of the present invention can be attained.

Specific structures and shapes for implementing the present invention may be other ones as long as the object of the present invention can be attained.

EXAMPLES

Now, the present invention will more specifically be described by providing examples and comparisons, the content of which by no means limits the present invention.

Example 1

The reclosable tape of the present invention having the shape as shown in FIG. 2 was obtained using the following resins for forming the seal portion and the base portion (including the engaging portion) and co-extruding the resins by two extruders.

As for properties of the resins, the melting point was measured in compliance with JIS K 7121, the density was measured in compliance with JIS K 7112, and the melt flow rate (MFR) was measured in compliance with JIS K 7210 (at 190° C. or 230° C., loading: 21.18 N). All of JIS K 7121, JIS K 7112 and JIS K 7210 are well known testing methods of plastics.

(Resin used: Seal Portion)

A metallocene-type linear low-density polyethylene having the density of 898 kg/m$^3$, the MFR of 3.5 g/10 min and the melting point of 90° C. was used (an α-olefin thereof is 1-hexene, which is the same in Examples 2 to 6), the content of which was 100 mass % of the total mass of the resin.

(Resin used: Base Portion)

A random polypropylene having the density of 900 kg/m$^3$, the MFR of 7.0 g/10 min and the melting point of 132° C. was used, the content of which was 100 mass % of the total mass of the resin.

The random polypropylene contained an ethylene component in an amount of 4 mass % of the total mass.

Example 2

A reclosable tape of the present invention was manufactured by the same method as Example 1, except that a resin that forms the seal portion contained a metallocene-type linear low-density polyethylene having the density of 900 kg/m$^3$, the MFR of 4.0 g/10 min and the melting point of 95° C. in an amount of 100 mass % of the total mass.

Example 3

A reclosable tape of the present invention was manufactured by the same method as Example 1, except that a resin that forms the seal portion contained: the metallocene-type linear low-density polyethylene having the density of 900 kg/m$^3$, the MFR of 4.0 g/10 min and the melting point of 95° C. in an amount of 70 mass % of the total mass; and a metallocene-type linear low-density polyethylene having the density of 900 kg/m$^3$, the MFR of 20 g/10 min and the melting point of 93° C. in an amount of 30 mass % of the total mass.

Example 4

A reclosable tape of the present invention was manufactured by the same method as Example 1, except that a resin that forms the seal portion contained: the metallocene-type linear low-density polyethylene having the density of 900 kg/m$^3$, the MFR of 4.0 g/10 min and the melting point of 95° C. in an amount of 50 mass % of the total mass; and the metallocene-type linear low-density polyethylene having the density of 900 kg/m$^3$, the MFR of 20 g/10 min and the melting point of 93° C. in an amount of 50 mass % of the total mass.

Example 5

A reclosable tape of the present invention was manufactured by the same method as Example 1, except that a resin that forms the seal portion contained: the metallocene-type linear low-density polyethylene having the density of 900 kg/m$^3$, the MFR of 4.0 g/10 min and the melting point of 95° C. in an amount of 70 mass % of the total mass; and a propylene-butene-1 copolymer having the density of 900 kg/m$^3$, the MFR of 3.2 g/10 min and the melting point of 110° C. in an amount of 30 mass % of the total mass.

Example 6

A reclosable tape of the present invention was manufactured by the same method as Example 1, except that a resin that forms the seal portion contained: the metallocene-type linear low-density polyethylene having the density of 900 kg/m$^3$, the MFR of 4.0 g/10 min and the melting point of 95° C. in an amount of 50 mass % of the total mass; and the propylene-butene-1 copolymer having the density of 900 kg/m$^3$, the MFR of 3.2 g/10 min and the melting point of 110° C. in an amount of 50 mass % of the total mass.

Comparison 1

A reclosable tape was manufactured by the same method as Example 1, except that: the reclosable tape was formed from a linear low-density polyethylene having the density of 920 kg/m$^3$, the MFR of 6.0 g/10 min and the melting point of 120° C., the content of which was 100 mass % of the total mass; and that the seal portion and the base portion were integrally formed.

Comparison 2

A reclosable tape was manufactured by the same method as Example 1, except that a resin that forms the seal portion contained a metallocene-type linear low-density polyethylene having the density of 900 kg/m$^3$, the MFR of 7.5 g/10 min and the melting point of 95° C. in an amount of 100 mass % of the total mass.

Comparison 3

A reclosable tape was manufactured by the same method as Example 1, except that a resin that forms the seal portion contained: the metallocene-type linear low-density polyethylene having the density of 900 kg/m$^3$, the MFR of 4.0 g/10 min and the melting point of 95° C. in an amount of 40 mass % of the total mass; and the metallocene-type linear low-density polyethylene having the density of 900 kg/m$^3$, the MFR of 20 g/10 min and the melting point of 93° C. in an amount of 60 mass % of the total mass.

Comparison 4

A reclosable tape was manufactured by the same method as Example 1, except that a resin that forms the seal portion contained: the metallocene-type linear low-density polyethylene having the density of 900 kg/m$^3$, the MFR of 4.0 g/10 min and the melting point of 95° C. in an amount of 30 mass % of the total mass; and the metallocene-type linear low-density polyethylene having the density of 900 kg/m$^3$, the MFR of 20 g/10 min and the melting point of 93° C. in an amount of 70 mass % of the total mass.

Comparison 5

A reclosable tape was manufactured by the same method as Example 1, except that a resin that forms the seal portion contained: the metallocene-type linear low-density polyethylene having the density of 900 kg/m$^3$, the MFR of 4.0 g/10 min and the melting point of 95° C. in an amount of 40 mass % of the total mass; and a propylene-butene-1 copolymer having the density of 890 kg/m$^3$, the MFR of 3.2 g/10 min and the melting point of 110° C. in an amount of 60 mass % of the total mass.

Comparison 6

A reclosable tape was manufactured by the same method as Example 1, except that a resin that forms the seal portion contained: the metallocene-type linear low-density polyethylene having the density of 900 kg/m$^3$, the MFR of 4.0 g/10 min and the melting point of 95° C. in an amount of 30 mass % of the total mass; and the propylene-butene-1 copolymer having the density of 890 kg/m$^3$, the MFR of 3.2 g/10 min and the melting point of 110° C. in an amount of 70 mass % of the total mass.

Test Example 1

The reclosable tapes obtained in Examples 1 to 6 and Comparisons 1 to 6 were each heat-sealed to a film base material shown below and three sides of the film base material were sealed using a commercially-available bag making machine for three-sided sealing and attaching the reclosable tape, the machine using a separator for welding the reclosable tape to the film base material in order to obtain a packaging bag with the reclosable tape having a size of 150 mm×200 mm.

(Arrangement of Film for Forming Bag Body)

The packaging bag with the reclosable tape was manufactured using two types of films as follows: a multilayer film (Film (A): the total thickness of 50 μm) formed from an oriented polypropylene film (OPP) (thickness: 20 μm)/a cast polypropylene film (CPP) (thickness: 30 μm); and an oriented nylon film (ONy) (thickness: 15 μm)/a linear low-density polyethylene film (LLDPE) (Film (B): total thickness of 50 μm).

As for Film (A), the cast polypropylene film defining a layer (sealant layer) to which the reclosable tape is welded was formed from the random polypropylene containing the ethylene component in an amount of 4 mass % of the total mass).

As for Film (B), the linear low-density polyethylene having the density of 920 kg/m$^3$, the MFR of 3.0 g/10 min and the melting point of 120° C. was used.

For each obtained packaging bag with the reclosable tape, (1) molding stability of female member, (2) peelability between seal portion of reclosable tape and sealant layer of bag body and (3) repeated peelability of reclosable tape were compared and evaluated using the following conditions. The evaluation results are shown in Table 1.

Incidentally, only the evaluation of (2) peelability was performed on the packaging bag with the reclosable tape having two type of bag bodies each formed from the above-described Film (A) and Film (B). The other evaluations were performed on the packaging bag with the reclosable tape having a bag body formed from Film (A).

(1) Molding Stability of Female Member (Shape Stability after Molding)

The molding stability was compared and evaluated on whether or not the male member and the female member of the reclosable tape could be engaged with each other in accordance with the following judgment items.

Judgment items

⊚: Properly engaged.

○: The opening between the tips of the first and second hooks 18, 19 of the female member is slightly small, which causes slight difficulty in the engagement.

Δ: The opening between the tips of the first and second hooks 18, 19 of the female member is small, which causes difficulty in the engagement.

x: The opening between the tips of the first and second hooks 18, 19 of the female member is closed, and therefore the female member cannot engage with the male member.

(2) Peelability

The seal portion of the reclosable tape was tried to be peeled off from the sealant layer of the bag body by hand to check whether the seal portion could be peeled off or not, which was compared and evaluated in accordance with the following criteria.

(Criteria: Peeling strength)

Judgment Items

ô: The reclosable tape cannot be peeled off by hand (Unpeelable).

○: The reclosable tape can be peeled off when being pulled strongly by hand, but is not peeled off by opening/resealing operation of the reclosable tape (Difficult to be peeled).

Δ: The reclosable tape is sometimes peeled off by the opening/resealing operation (Slightly difficult to be peeled).

x: The reclosable tape is peeled off by the opening/resealing operation of the engaging portion of the reclosable tape (Easily peeled).

(3) Repeated Peelability

After the reopening/resealing operation of the engaging portion was repeated 100 times, whether or not there is a peeled portion between the seal portion of the reclosable tape and the sealant layer of the bag body was visually checked, which was compared and evaluated in accordance with the following criteria.

(Criteria: Peeling strength)

Judgment Items

○: There is no peeled portion.

x: There is a peeled portion.

The evaluation results are shown in Table 1 with total evaluation results. Incidentally, the total evaluation result was determined as "not passed (x)" when there was one "x" and as "passed" when there was no "x" in the evaluation items (1) to (3).

(Result)

TABLE 1

| | (1) molding | (2) Peelability | | | |
|---|---|---|---|---|---|
| | stability (female member) | Sealant layer CPP | Sealant layer LLDPE | (3) Repeated peelability | Total evaluation |
| Example 1 | Δ | ◎ | ◎ | ○ | ○ |
| Example 2 | Δ | ◎ | ◎ | ○ | ○ |
| Example 3 | ○ | ○ | ◎ | ○ | ○ |
| Example 4 | ○ | Δ | ◎ | ○ | ○ |
| Example 5 | ○ | ◎ | ◎ | ○ | ○ |
| Example 6 | ○ | ◎ | ◎ | ○ | ○ |
| Comparison 1 | ◎ | x | ◎ | x | x |
| Comparison 2 | Δ | x | ◎ | ○ | ○ |
| Comparison 3 | ○ | x | ◎ | ○ | ○ |
| Comparison 4 | ◎ | x | ◎ | x | x |
| Comparison 5 | ○ | ○ | x | ○ | ○ |
| Comparison 6 | ◎ | ◎ | x | x | x |

As shown in Table 1, the reclosable tapes obtained in Examples 1 to 6 of the present invention could each be heat-sealed, with an adhesion strength of a practical level, not only to the bag body having the sealant layer formed from the linear low-density polyethylene but also to the bag body having the sealant layer formed from the cast polypropylene film.

In each of the reclosable tapes of Examples 1 and 2, the shape of the engaging portion was slightly deformed and the opening between the tips of the first and second hooks 18, 19 became small, though the deformation was so slight that it practically caused no problem in the reopening/resealing operation (repeated operations of opening and sealing). In each of the reclosable tapes of Examples 3 to 6 in which the seal portion contains 1 to 50 mass % of the metallocene-type linear low-density polyethylene having the density of 920 kg/m$^3$ or lower and the MFR of higher than 5.0 g/10 min and/or the propylene-butene-1 copolymer, the opening between the first and second hooks 18, 19 became small only to a slight degree. Note that the resin that forms the base portion was the random polypropylene having a high melting point of 132° C. in these Examples where it was difficult to obtain shape stability in the extrusion.

The reclosable tapes obtained in Examples 1 to 6 of the present invention were not peeled off from the bag body even after the repeated operations, thus verified to have excellent performance in repeated peelability.

On the other hand, none of the reclosable tapes obtained in Comparisons 1 to 6 could be heat-sealed, with adhesion strength of the practical level, to both of the bag bodies with the sealant layers formed from the linear low-density polyethylene film and the cast polypropylene film. Accordingly, none of the reclosable tapes of Comparisons 1 to 6 could be evaluated as "passed" in the total evaluation with the other evaluation items.

Therefore, all of the reclosable tapes of Comparisons that did not meet requirements of the present invention were greatly inferior to the reclosable tapes of Examples.

INDUSTRIAL APPLICABILITY

A reclosable tape and a packaging bag with the reclosable tape according to the present invention can be widely used as a reclosable tape and a packaging bag with the reclosable tape for packaging various articles such as foods, medical products, etc

The invention claimed is:

1. A reclosable tape, comprising a male member and a female member each constituted by a belt-shaped base having an engaging portion, wherein the belt-shaped base includes a seal portion and a base portion that is formed continuously from and integrally with the engaging portion, a resin that forms the base portion has a melting point higher than that of a resin that forms the seal portion, and the resin that forms the seal portion contains: 50 to 99 mass % of the metallocene based linear low-density polyethylene having the density of 920 kg/m$^3$ or lower and the melt flow rate (MFR) of 5.0 g/10 min or lower; and 1 to 50 mass % of at least one of the following resins (a) and (b)

(a) a metallocene based linear low-density polyethylene having a density of 920 kg/m$^3$ or lower and a melt flow rate (MFR) of higher than 5.0 g/10 min, and (b) a copolymer of a propylene and an α-olefin having a carbon number of 4 to 8.

2. The reclosable tape according to claim 1, wherein a melting point of the resin that forms the base portion is 10° C. or more higher than a melting point of the resin that forms the seal portion.

3. The reclosable tape according to claim 1, wherein the resin that forms the base portion is a random polypropylene having a melt flow rate (MER) of 3 to 10 g/10 min.

4. A packaging bag with a reclosable tape that is formed by welding, a reclosable tape to a bag body, the reclosable tape including a male member and a female member that are each constituted by a belt-shaped base having an engaging portion, wherein in the reclosable tape, the belt-shaped base includes a seal portion and a base portion that is formed continuously from and integrally with the engaging portion, a resin that forms the base portion has a melting point higher than that of a resin that forms the seal portion, and the resin that forms the seal portion contains: 50 to 99 mass % of the metallocene based linear low-density polyethylene having the density of 920 kg/m$^3$ or lower and the melt flow rate (MFR) of 5.0 g/10 min or lower; and 1 to 50 mass % of at least one of the following resins (a) and (b)

(a) a metallocene based linear low-density polyethylene having a density of 920 kg/m$^3$ kg/m$^3$ or lower and a melt flow rate (MFR) of higher than 5.0 g/10 min, and (b) a copolymer of a propylene and an α-olefin having a carbon number of 4 to 8.

5. The packaging bag according to claim 4, wherein the bag body has a sealant layer as an innermost layer thereof, a resin that forms the sealant layer is a polypropylene resin.

6. The packaging bag according to claim 4, wherein a melting point of the resin that forms the base portion is 10° C. or more higher than a melting point of the resin that forms the seal portion.

7. The packaging bag according to claim 4, wherein the resin that forms the base portion is a random polypropylene having a melt flow rate (MFR) of 3 to 10 g/10 min.

* * * * *

UNITED STATES PATENT AND TRADEMARK OFFICE

CERTIFICATE OF CORRECTION

PATENT NO. : 7,736,058 B2
APPLICATION NO. : 11/597131
DATED : June 15, 2010
INVENTOR(S) : Tanaka et al.

It is certified that error appears in the above-identified patent and that said Letters Patent is hereby corrected as shown below:

On the title page, item (57), the last line reads "rate of 5.0g/1 10 min or lower." should read -- rate of 5.0 g/10 min or lower, --

Column 14, line 59 reads "having a melt flow rate (MER) of 3 to 10g/10 min." should read -- having a melt flow rate (MFR) of 3 to 10g/10 min. --

Column 15, line 10 reads "having a density of 920kg/$m^3$ kg/$m^3$ or lower and a melt" should read -- having a density of 920kg/$m^3$ or lower and a melt --

Signed and Sealed this

Tenth Day of August, 2010

David J. Kappos

David J. Kappos
*Director of the United States Patent and Trademark Office*